US006945082B2

(12) United States Patent
Field et al.

(10) Patent No.: US 6,945,082 B2
(45) Date of Patent: Sep. 20, 2005

(54) KEY BLANK, KEY AND MASTER KEYING SYSTEM

(75) Inventors: Peter H. Field, Salem, VA (US); Andy E. Perkins, Lafayette, VA (US); Anthony Hicks, Roanoke, VA (US); Mark Benzie, Roanoke, VA (US); Glenn Hartman, Salem, VA (US); Clyde Roberson, Salem, VA (US); Thomas Duckwall, Roanoke, VA (US); Kevin Lee, Salem, VA (US); W. Daniel Boadwine, Salem, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

(21) Appl. No.: 10/260,420

(22) Filed: Oct. 1, 2002

(65) Prior Publication Data

US 2003/0024287 A1 Feb. 6, 2003

Related U.S. Application Data

(63) Continuation-in-part of application No. 09/981,801, filed on Oct. 19, 2001, now Pat. No. 6,477,875, which is a continuation-in-part of application No. 09/776,929, filed on Feb. 6, 2001, now abandoned.

(51) Int. Cl.[7] ..... E05B 19/06; E05B 27/04; E05B 27/08

(52) U.S. Cl. ..... 70/409; 70/491; 70/494; 70/495; 70/496

(58) Field of Search ..... 70/409, 491, 493–496, 70/419, 402, 450–407, 411

(56) References Cited

U.S. PATENT DOCUMENTS

| | | | | |
|---|---|---|---|---|
| 3,492,843 A | * | 2/1970 | Scheiber et al. | 70/388 |
| 3,499,302 A | | 3/1970 | Spain et al. | |
| 3,681,955 A | * | 8/1972 | Sturgeon | 70/491 |
| 3,722,240 A | | 3/1973 | Spain et al. | |
| 3,733,863 A | * | 5/1973 | Toepfer | 70/496 |
| 3,738,136 A | * | 6/1973 | Falk | 70/491 |
| 3,748,881 A | | 7/1973 | Erickson | |
| 4,635,455 A | | 1/1987 | Oliver | |
| 4,732,022 A | | 3/1988 | Oliver | |
| 4,996,856 A | * | 3/1991 | Lin et al. | 70/359 |
| 5,289,709 A | | 3/1994 | Field | |
| 5,335,520 A | * | 8/1994 | Lee | 70/349 |
| 5,419,168 A | | 5/1995 | Field | |
| 5,570,601 A | | 11/1996 | Field | |
| 5,615,566 A | * | 4/1997 | Brandt | 70/419 |
| 6,477,875 B2 | * | 11/2002 | Field et al. | 70/491 |
| 2002/0056301 A1 | | 5/2002 | Theriault et al. | |

FOREIGN PATENT DOCUMENTS

DE 28 28 343 A1 1/1980

* cited by examiner

*Primary Examiner*—Lloyd A. Gall
(74) *Attorney, Agent, or Firm*—Rothwell, Figg, Ernst & Manbeck

(57) ABSTRACT

A key blank, key and master keying system for a twisting tumbler sidebar lock of the type where the sidebar is blocked or unblocked by a selectively positioned longitudinally extending slider, has a key blank with a slider contacting surface on a rib on the blank below the bitting area at one of a plurality of selected predetermined locations. A key with skew cut bittings can be cut on the blank and the blank can be configured with the slider contacting surface at different predetermined locations. The slider contact area on the rib of the key blank can be divided into two horizontal portions at different predetermined locations and the slider itself can have contact surfaces also positioned at different predetermined locations so that a number of different master keying variations are possible.

8 Claims, 8 Drawing Sheets

FIGURE 1a
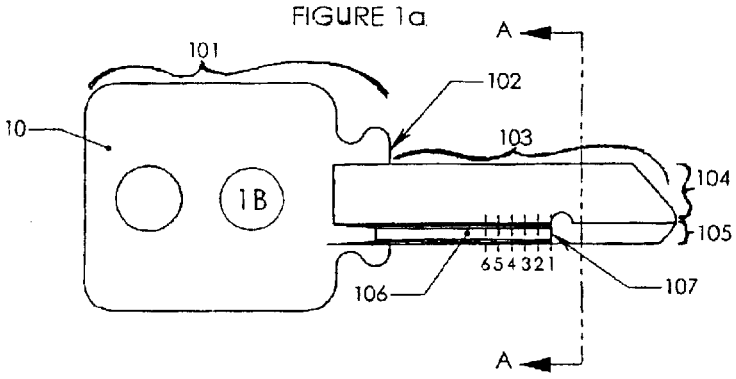
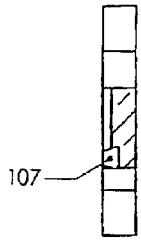
FIGURE 1b
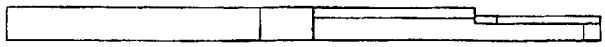
FIGURE 1c
FIGURE 2a
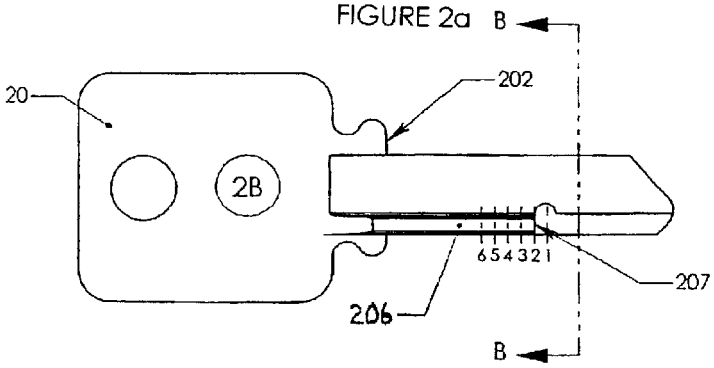
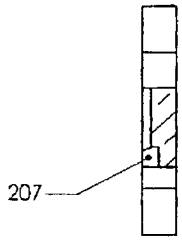
FIGURE 2b
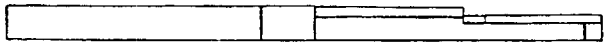
FIGURE 2c
FIGURE 3a
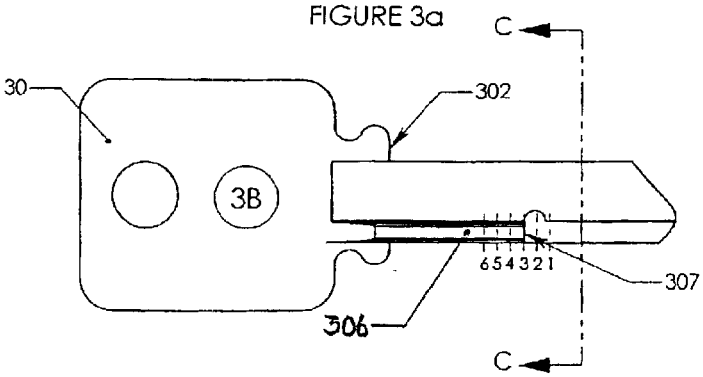
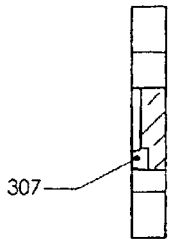
FIGURE 3b
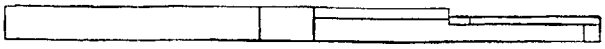
FIGURE 3c FIGURE 4a
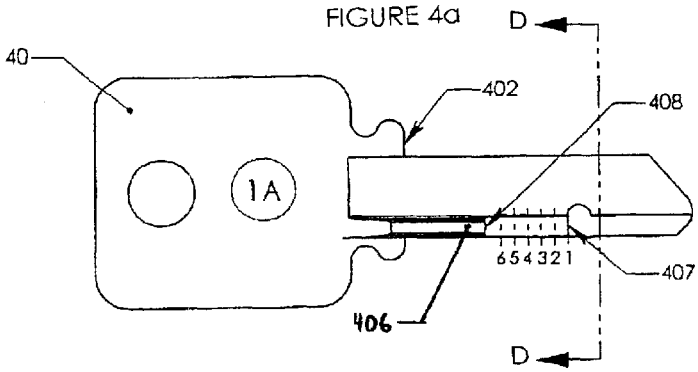
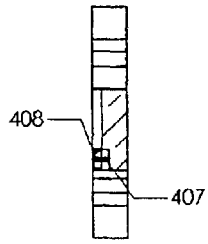
FIGURE 4b
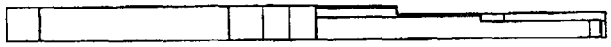
FIGURE 4c
FIGURE 5a
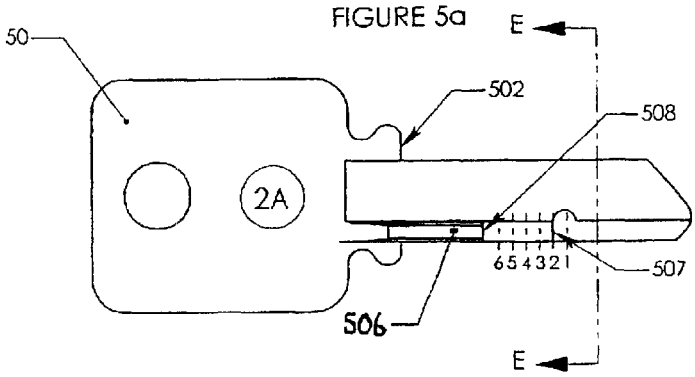
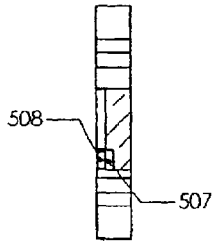
FIGURE 5b
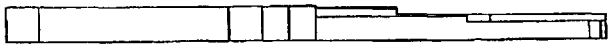
FIGURE 5c
FIGURE 6a
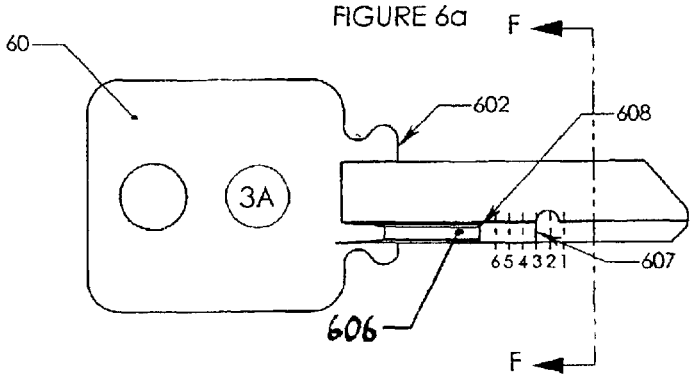
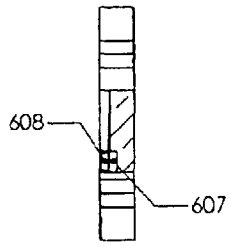
FIGURE 6b
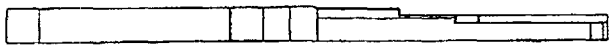
FIGURE 6c FIGURE 14a
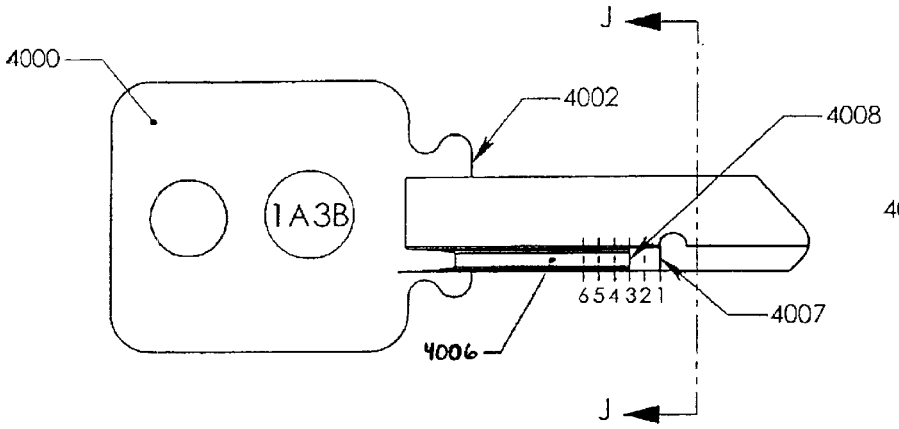
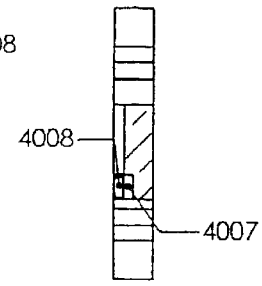
FIGURE 14b
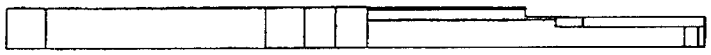
FIGURE 14c FIGURE 15a
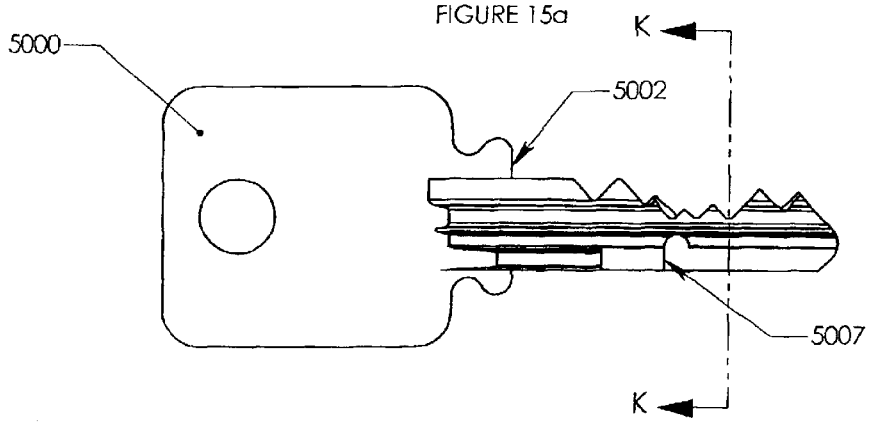
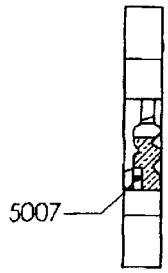
FIGURE 15b
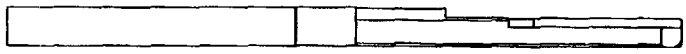
FIGURE 15c
FIGURE 16a
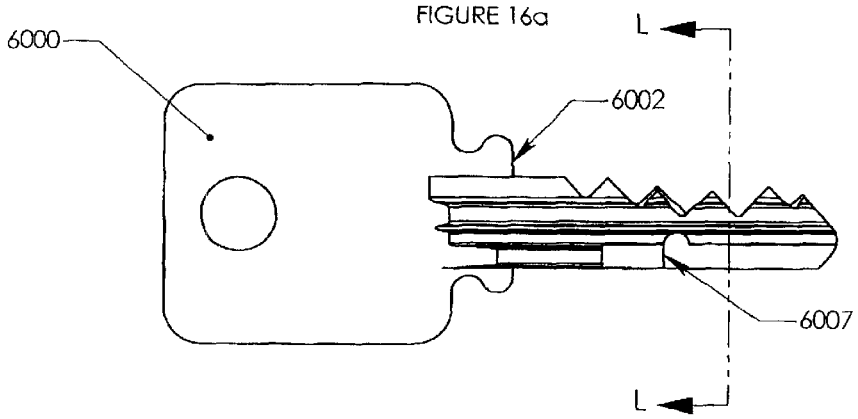
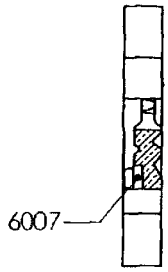
FIGURE 16b
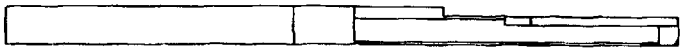
FIGURE 16c

KEY BLANK, KEY AND MASTER KEYING SYSTEM

CROSS-REFERENCE TO RELATED APPLICATION

The present application is a continuation-in-part of U.S. application Ser. No. 09/981,801 filed Oct. 19, 2001, now U.S. Pat. No. 6,477,875, which in turn is a continuation-in-part of U.S. application Ser. No. 09/776,929 filed Feb. 6, 2001, now abandoned.

BACKGROUND OF THE INVENTION

1. Field of the Invention

The present invention relates to improvements in key and key blank configurations for use with twisting tumbler/sidebar-slider controlled cylinder locks of the type disclosed in the parent applications, and a master keying system therefor.

2. Description of the Background Art

Keys to operate locks with rotating reciprocating (twisting) tumblers are conventionally bitted on the upper portion of the key blade with skew cut bittings. The skew cuts operate in combination with chisel pointed spring loaded tumbler pins to position the pins at the correct location to operate the cylinder. This type of lock is known as a Medeco lock made by Medeco Security Locks, Inc. of Salem, Va. Medeco cylinders of this type are well-known and their construction and operation is disclosed, for example, in U.S. Pat. No. 3,499,302 (Spain et al.) and U.S. Pat. No. 3,722,240 (Spain et al.). Other and later patents, for example, describing the Medeco locks are U.S. Pat. No. 4,635,455 (Oliver), U.S. Pat. No. 4,732,022 (Oliver), U.S. Pat. No. 5,289,709 (Field), U.S. Pat. No. 5,419,168 (Field) and U.S. Pat. No. 5,570,601 (Field).

The first generation of twisting tumbler locks, for example, rotating pin tumblers with skew cut keys manufactured by Medeco Security Locks, Inc., utilized variations in the pins to establish a master keying system. This technique is well-known in the lock industry.

The second generation of Medeco locks was sold under the trademark BIAXTAL and expanded on the master keying capabilities of the original Medeco products by offsetting the key bittings along the blade of the key and providing pins with different offset tips. This construction and technique is disclosed, for example, in U.S. Pat. No. 4,635,445 (Oliver) and U.S. Pat. No. 4,732,022 (Oliver).

SUMMARY OF THE INVENTION

The ability of a locksmith or lock manufacturer to configure lock cylinders to operate in master keying systems is quite important in the lock industry. The present invention provides additional benefits in increased master keying which is primarily attributed to the uniquely formed key blank and key operating with a third level locking slider for the Medeco lock as disclosed in U.S. application Ser. No. 09/981,801, which is incorporated herein by reference.

The key of the present invention has a conventional bitting area and, on the side of the key blade, a rib that projects horizontally from a longitudinal axis of the key. The rib of the present invention is provided with a front end to contact a slider that moves axially within the cylinder. By varying the structure, configuration and placement of the front end of the rib and the slider contact surface, a unique master keying system has been developed whereby each lock can be operated by its own key and groups of locks can be operated by a master key. In other words, new master keying systems are disclosed using a unique technique which requires a rib on the side of the key blank to interact with a uniquely configured sliding member in the cylinder. The sliding member functions to block the operation of the cylinder until the key correctly positions the slider as explained in U.S. application Ser. No. 09/981,801.

U.S. application Ser. No. 09/981,801 discloses variations of the front end of the rib that contacts the slider whereby the front ends are sloped at an angle or stepped in a vertical plane. The present invention provides variations in the depths of the front end of the slider along a horizontal plane of the key. Further, the present invention improves on the invention of U.S. application Ser. No. 09/981,801 in that the structure of the fore end of the rib on the key and the structure of the mating contact area on the slider and the cylinder are configured so that there are spaced horizontal areas which can then be used to significantly increase the master keying capabilities.

The above and other features and advantages of the present invention will be further understood from the following description of the preferred embodiments thereof, taken in conjunction with the accompanying drawings wherein like reference numerals are used throughout the various views to designate like parts.

BRIEF DESCRIPTION OF THE DRAWINGS

FIG. 1*a* is a side elevation view of a key blank according to the present invention.

FIG. 1*b* is a sectional view taken along line A—A of the key blank of FIG. 1*a*.

FIG. 1*c* is a bottom plan view of the key blank of FIG. 1*a*.

FIG. 2*a* is a side elevation view of another configuration of a key blank according to the present invention.

FIG. 2*b* is a sectional view taken along line B—B of the key blank in FIG. 2*a*.

FIG. 2*c* is a bottom plan view of the key blank of FIG. 2*a*.

FIG. 3*a* is a side elevation view of yet another configuration of a key blank according to the present invention.

FIG. 3*b* is a sectional view taken along line C—C of the key blank of FIG. 3*a*.

FIG. 3*c* is a bottom plan view of the key blank of FIG. 3*a*.

FIG. 4*a* is a side elevation view of a key blank with a different configuration of contact surfaces on a slider contacting rib according to the present invention.

FIG. 4*b* is a sectional view taken along line D—D of the key blank of FIG. 4*a*.

FIG. 4*c* is a bottom plan view of the key blank of FIG. 4*a*.

FIG. 5*a* is a side elevation view of another key blank with a different configuration of contact surfaces on a slider contacting rib according to the present invention.

FIG. 5*b* is a sectional view taken along line E—E of the key blank of FIG. 5*a*.

FIG. 5*c* is a bottom plan view of the key blank of FIG. 5*a*.

FIG. 6*a* is a side elevation view of yet another key blank with a different configuration of contact surfaces on a slider contacting rib according to the present invention.

FIG. 6*b* is a sectional view taken along line F—F of the key blank of FIG. 6*a*.

FIG. 6*c* is a bottom plan view of the key blank of FIG. 6*a*.

FIG. 14*a* is a side elevation view of a further key blank according to the present invention with a particular surface rib contact.

FIG. 14*b* is a sectional view taken along line J—J of the key blank of FIG. 14*a*.

FIG. 14*c* is a bottom plan view of the key blank of FIG. 14*a*.

FIG. 15*a* illustrates a Medeco BIAXIAL® key incorporating the slider contact rib according to the present invention.

FIG. 15*b* is a sectional view taken along line K—K of the key of FIG. 15*a*.

FIG. 15*c* is a bottom plan view of the key of FIG. 15*a*.

FIG. 16*a* illustrates an original Medeco key incorporating the slider contact rib according to the present invention.

FIG. 16*b* is a sectional view taken along line L—L of the key of FIG. 16*a*.

FIG. 16*c* is a bottom plan view of the key of FIG. 16*a*.

DETAILED DESCRIPTION OF THE PREFERRED EMBODIMENTS

Figure 7:
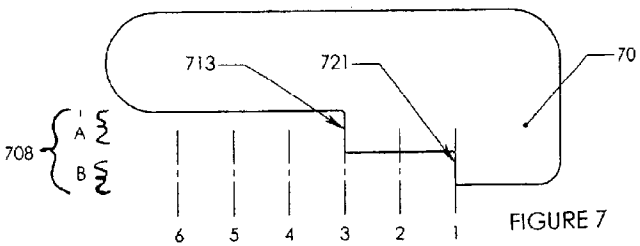
FIG. 7 is a bottom plan view of a slider illustrating one of the many possible key contact variations.

With reference to FIGS. 1*a–c*, a key blank 10 is comprised of a key head or key bow 101, a key blade portion 103 extending from the key bow 101 as is conventional, and a key stop 102. The key stop 102 limits the insertion of a key into a lock cylinder plug. The key blade 103 is divided vertically into two areas, the top area is a skewed cut bitting area 104 and the bottom area is a slider contact rib area 105.

Variations in the key blank 10 are achieved in part by the length of a slider contact rib 106. These variations are measured longitudinally from the key stop 102 to a fore end 107 of the slider contact rib 106. On the key blank 10, as illustrated in FIGS. 1*a–c*, the fore end 107 of the slider contact rib 106 is positioned at predetermined location 1.

FIGS. 2*a–c* show a similarly configured key blank 20 with a key stop 202 and a fore end 207 of a slider contact rib 206 which is positioned at predetermined location 2.

With reference to FIGS. 3*a–c*, a key blank 30 similar to the key blanks described above has a key stop 302 and a slider contact rib 306 with a fore end 307 positioned at predetermined location 3.

FIGS. 4*a–c* show a key blank 40 having a key stop 402 and a slider contact rib 406. The slider contact rib 406 has two separate fore end portions: an inner part 407 and an outer part 408. As can be seen, the inner part 407 of the fore end is positioned at predetermined location 1 while the outer part 408 of the fore end is positioned beyond predetermined location 6.

With regard to FIG. 5, a key blank 50 is of similar configuration having a key stop 502 and a slider contact rib 506 with an inner part 507 of a fore end positioned at predetermined location 2 and an outer part 508 of the fore end positioned beyond predetermined location 6.

Similarly, the key blank 60 illustrated in FIG. 6 has a key stop 602. A fore end of a slider contact rib 606 has two portions: an inner part 607 and an outer part 608. The inner part 607 of the fore end is positioned at predetermined location 3 and the outer part 608 of the fore end is positioned beyond predetermined location 6.

With reference to FIGS.14*a–c*, a key blank 4000 has a key stop 4002 and a slider contact rib 4006. The slider contact rib 4006 has two contact end portions 4007 and 4008. The contact end portion 4007 is at a predetermined position 1 and the contact end portion 4008 is at a predetermined position 3.

A Medeco BIAXIAL® lock can be modified to utilize the slider contact rib on a key blank of the present invention. FIG. 15*a* illustrates the Medeco BIAXIAL® key incorporating the slider contact rib on the side of the key. Referring to FIGS. 15*a–c*, a key 5000 has a stop 5002 and a slider contact rib 5007.

An original Medeco cylinder lock can also be modified to utilize the slider contact rib on a key blank of the present invention. FIG. 16*a* illustrates the original cylinder Medeco key incorporating the slider contact rib on the side of the key. Referring to FIGS. 16*a–c*, a key 6000 has a stop 6002 and a slider contact rib 6007.

Figure 8:
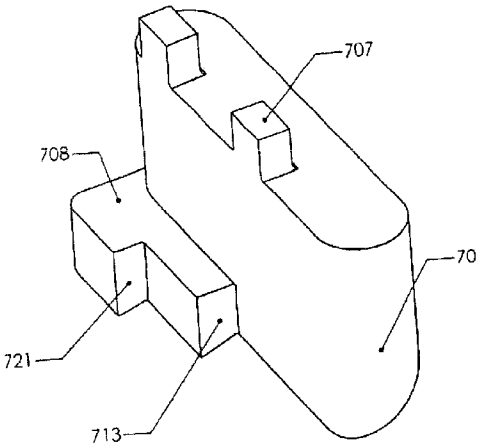
FIG. 8 is a perspective view of the slider shown in FIG. 7.

With regard to FIGS. 7 and 8, a slider 70 has at least one projection 707 on its top surface that must be precisely positioned before the lock cylinder can open, as explained in the above-referenced application. On the bottom edge of the slider 70 is a key contact rib 708 that contains contact areas that mate with a slider contact rib on a key. On the slider 70, contact area 713 is configured to a predetermined location 3 so that the contact area 713 mates with a fore end of the slider contact rib on the key. The other contact area 721 is configured to a predetermined location 1 and has a contact surface to mate with a fore end of the slider contact rib on the key.

Figure 9:
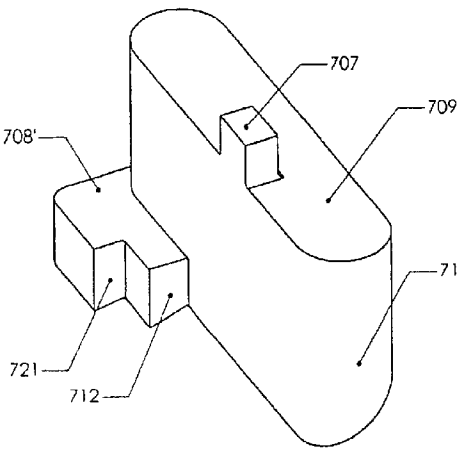
FIG. 9 is a perspective view of a slider similar to FIG. 8 but shown with a different configuration of key rib contact surfaces.

FIG. 9 shows another embodiment of a slider 71 which has a slider body 709 and a key contact rib 708' that contains contact areas 712, 721. The contact areas 712, 721 mate with a slider contact rib on a key, and are configured to two predetermined locations. The contact area 712 closest to the slider body 709 is configured to predetermined location 2 for mating with a fore end of the slider contact rib on the key. The contact area 721 farthest from the slider body 709 is configured to predetermined location 1 for mating with a fore end of the slider contact rib on the key.

Figure 10:
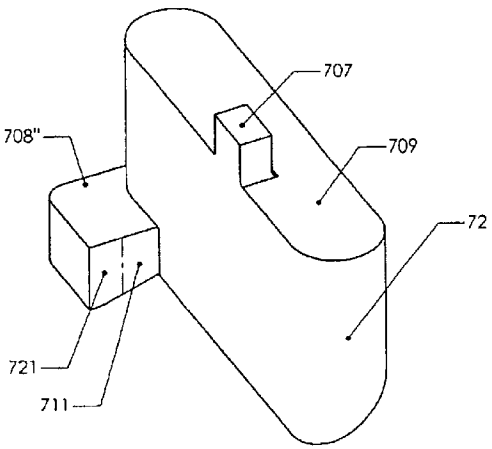
FIG. 10 is a perspective view of a slider showing yet another configuration of key rib contact surfaces.

With regard to FIG. 10, a further slider configuration is shown. A slider 72 contains contact areas 711, 721 that mate with a slider contact rib on a key. Similarly, the contact areas 711, 721 are configured to two predetermined locations. The contact area 711 closest to the slider body 709 is configured to predetermined location 1 for mating with the fore end of the slider contact rib on the key. The contact area 721 furthest away from the slider body 709 is also configured to predetermined location 1 for mating with a fore end of the slider contact rib on the key.

Figure 11B:
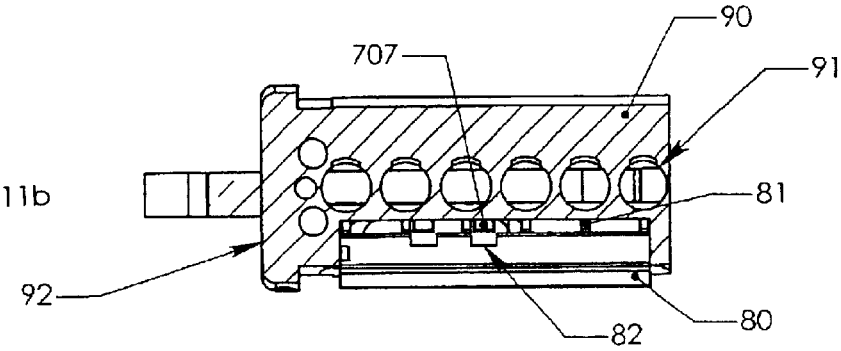
FIG. 11*b* is a sectional view taken along line G—G of the arrangement shown in FIG. 11*a*.
Figure 11A:
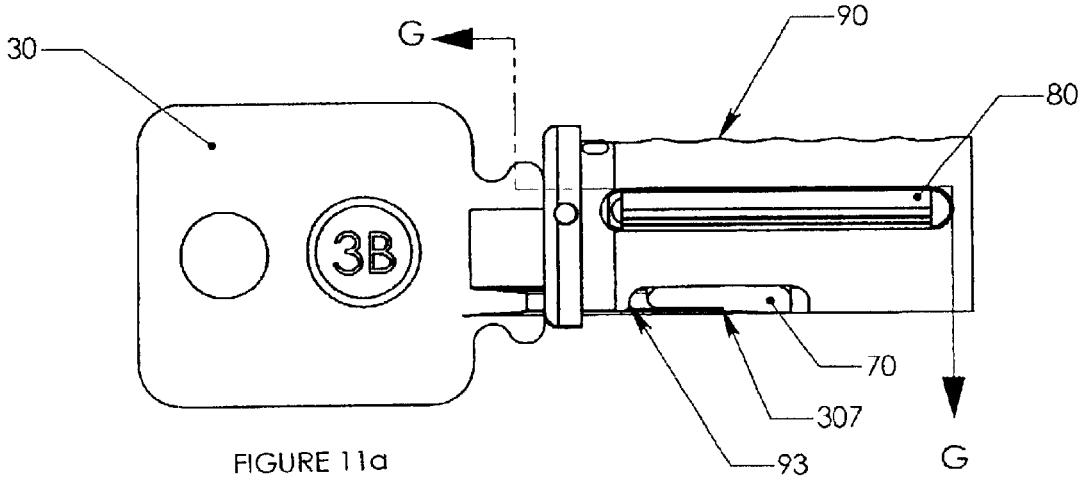
FIG. 11*a* is a side elevation view of a cylinder lock illustrating the operation of a properly configured key blank according to the present invention.
Figure 11C:
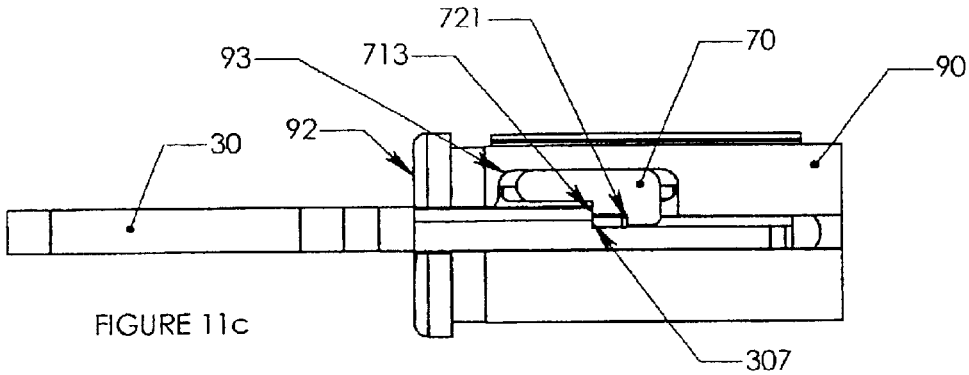
FIG. 11*c* is a bottom plan view of the arrangement shown in FIG. 11*a*.

The operation of the key for locking/unlocking a cylinder lock or locks with rotating reciprocating (twisting) tumblers will now be described with reference to FIGS. 11–13. As illustrated in FIGS. 11*a–c*, a lock cylinder plug 90 contains tumbler pin holes 91 to house Medeco-type chisel pointed rotatable tumbler pins (not shown). Contained within the lock cylinder plug 90 is a sidebar 80 with sidebar legs 81 as is known in the art of Medeco locks. The sidebar 80 has at least one notch 82 to receive the corresponding projection 707 on the slider 70 (FIGS. 7–10) when the key correctly positions the slider 70. The slider 70 fits into a cavity 93 in the lock cylinder plug 90 and is biased by a spring (not shown) towards a face 92 of the lock cylinder plug 90. When the key 30, illustrated in FIGS. 3*a–c*, for example, is inserted into the lock cylinder plug 90, the contact area 713 on the slider 70 mates with the fore end 307 on the key to correctly position the slider 70 within the lock cylinder plug 90.

Figure 12B:
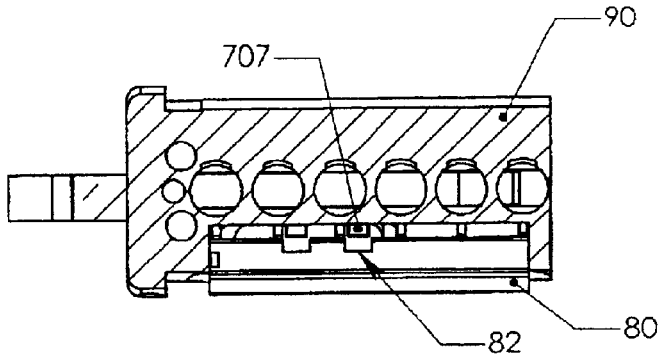
FIG. 12*b* is a sectional view taken along line H—H of the arrangement shown in FIG. 12*a*.
Figure 12A:
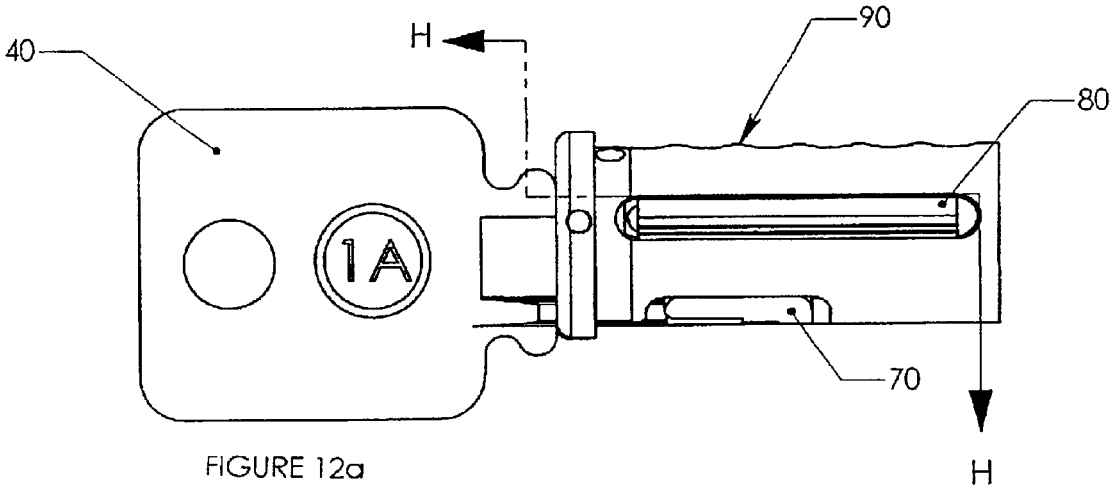
FIG. 12*a* is a side elevation view of another cylinder lock illustrating the operation of a properly configured key blank according to the present invention.
Figure 12C:
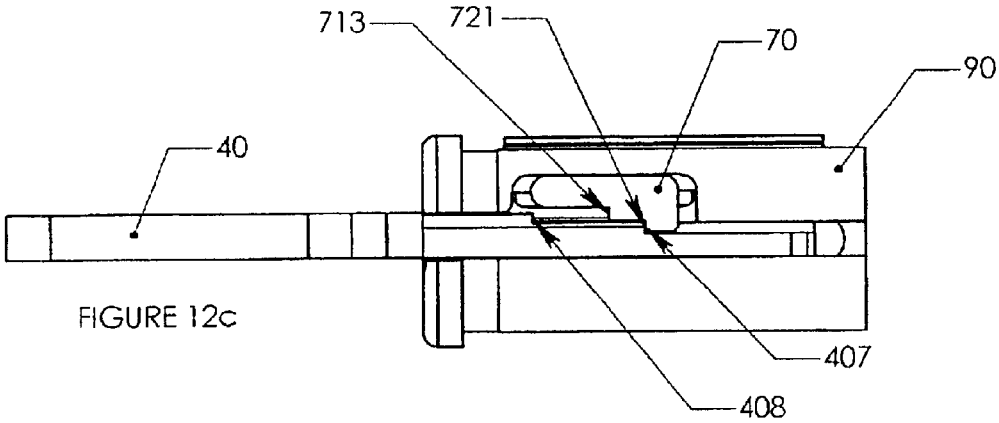
FIG. 12*c* is a bottom plan view of the arrangement shown in FIG. 12*a*.

As illustrated in FIGS. 12*a–c*, the lock cylinder plug 90 containing slider 70 can also be operated, for example, with the key 40, as illustrated in FIGS. 4*a–c*. The slider contact rib 406 on the key 40 is provided with the inner part 407 of the fore end and the outer part 408 of the fore end. The inner part 407 of the fore end is positioned at predetermined location 1 and the outer part 408 of the fore end is positioned at predetermined location 6. The inner part 407 of the fore end mates with the contact area 721 on the slider 70 and positions the slider 70 in a correct operating location. The outer part 408 of the fore end is sufficiently clear of the contact area 713 on the slider 70 and does not mate with the contact area 713.

Figure 13B:
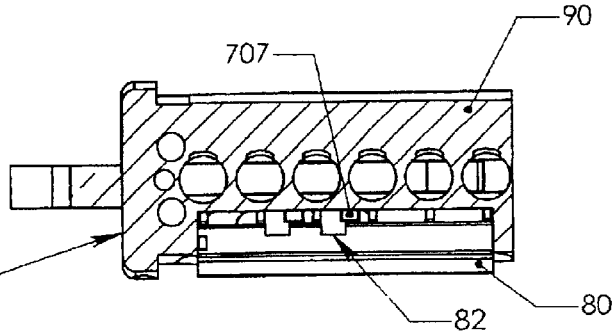
FIG. 13*b* is a sectional view taken along line I—I of the arrangement shown in FIG. 13*a*.
Figure 13A:
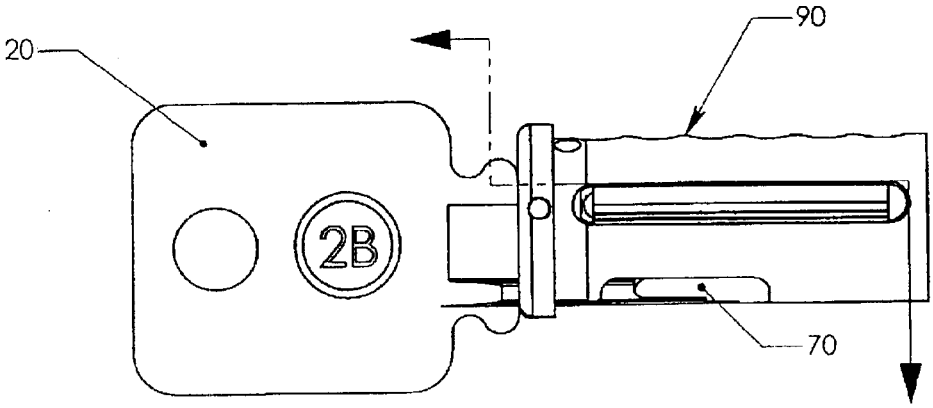
FIG. 13*a* is a side elevation view of a slider controlled lock illustrating the operation of an improperly configured key blank according to the present invention.
Figure 13C:
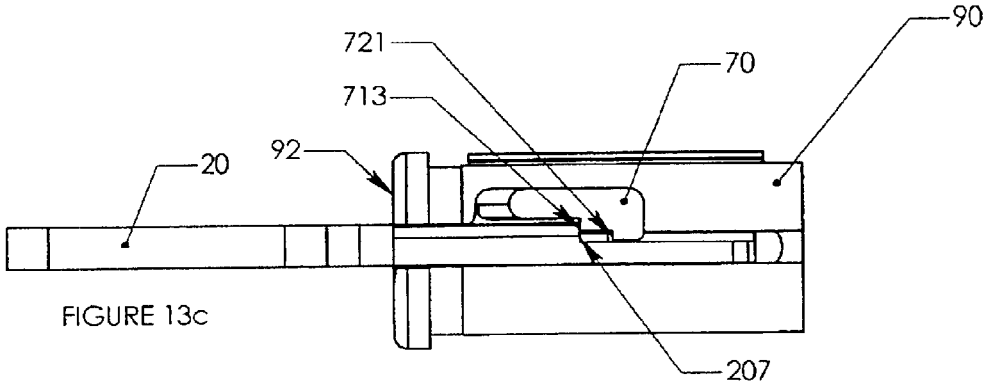
FIG. 13*c* is a bottom plan view of the arrangement shown in FIG. 13*a*.

As illustrated in FIGS. 13 *a–c*, the lock cylinder plug 90 containing slider 70 cannot be operated, for example, with the key 20 (FIGS. 2*a–c*). The fore end 207 of the slider contact rib 206 is positioned at predetermined location 2. When the key 20 is inserted into the lock cylinder plug 90, the key contact rib 713 on the slider 70 mates with the fore end 207 of the slider contact rib 206. The slider 70 moves so far away from the face 92 of the lock cylinder plug 90 that the projection 707 will not fit within the notch 82 on the sidebar 80.

When a key with the unique slider contact rib as disclosed herein is inserted into a lock cylinder plug containing the unique slider described in the aforementioned application, the first contact surface on the slider contact rib to mate with the key contact surface on the slider will position the slider in the lock cylinder plug. However, if the key 4000 (FIGS. 14*a–c*), for example, is used in a lock cylinder containing the slider 70, both surfaces 4007, 4008 will mate with contact areas 712, 721 simultaneously, and thus, both surfaces 4007, 4008 will position the slider 70.

By positioning the slider contact rib on the key blank to six predetermined locations and dividing the slider contact rib into two horizontal contact surfaces, it is possible to configure 21 (twenty one) different key blanks to fit into one keyway of a cylinder lock.

A key blank could be configured into any one of the following 21 possibilities by identifying the inner part or innermost horizontal contact surface as 1*a*, 2*a*, 3*a*, 4*a*, 5*a* and 6*a*, and the outer part or outermost horizontal contact surface as 1*b*, 2*b*, 3*b*, 4*b*, 5*b* and 6*b:*

1*b*-1*a*
2*b*-1*a*
2*b*-2*a*
3*b*-1*a*
3*b*-2*a*
3*b*-3*a*
4*b*-1*a*
4*b*-2*a*
4*b*-3*a*
4*b*-4*a*
5*b*-1*a*
5*b*-2*a*
5*b*-3*a*
5*b*-4*a*
5*b*-5*a*
6*b*-1*a*
6*b*-2*a*
6*b*-3*a*
6*b*-4*a*
6*b*-5*a*
6*b*-6*a*

Similarly, sliders of cylinder locks can be configured into the same 21 different arrangements.

A lock containing a 3*b*-1*a* slider can be operated by keys with the following configurations:

3*b*-1*a*
3*b*-2*a*
3*b*-3*a*
4*b*-1*a*
5*b*-1*a*
6*b*-1*a*

With the above key blank and slider configurations, and the existing Medeco master keying techniques, a much larger and more complex master keying system can be provided than that previously known and available.

Although the present invention has been described with reference to the particular embodiments disclosed, it is understood that these embodiments are merely illustrative of the application and principles of the invention. Numerous other configurations can be made and other arrangements can be devised without departing from the spirit and scope of the invention as defined in the appended claims.

What is claimed is:

1. A key blank for use in cutting a key which key is for a twisting tumbler/sidebar type lock having a slider for blocking or allowing operation of the sidebar, the key blank comprising:

a key bow;

a key stop on the key bow;

a key blade adjacent the key bow, the key blade having a longitudinally-extending skew cut bitting surface area vertically arranged along one longitudinal edge of the key blade; and a slider contact area extending longitudinally of the key blade below the skew cut bitting surface area, said slider contact area having a slider contact area surface configuration divided horizontally into at least two portions, wherein the slider contact area surface configuration is located on one side of the key blade and positioned at at least one of a predetermined number of locations spaced longitudinally from the key bow.

2. The key blank as defined in claim 1, wherein the slider contact area surface configuration is spaced horizontally from a plane of the key blade.

3. A cylinder lock combination, comprising:

at least two key blanks as defined in claim 2 having at least two slider contact area surface configurations; and a slider for blocking or allowing operation of a sidebar in a twisting tumbler/sidebar type lock with a keyway having two contact surface portions on the slider selectively positioned to allow different key blanks to be insertable into the same keyway.

4. A key for use in a lock having twisting tumblers operated by skew cut bittings on the key, a sidebar and a locking slider for selectively blocking or allowing operation of the sidebar, the key comprising:

a key bow;

a key stop on the key bow limiting the insertion of the key into keyway;

a key blade having a longitudinally-extending top edge with a plurality of the skew cut bittings extending vertically along the top edge; and a slider contact area extending longitudinally along the key blade below the skew cut bittings, said slider contact area having a slider contact area surface configuration divided horizontally into at least two portions, wherein the slider contact area surface configuration contacts and moves the locking slider when a properly cut key is inserted into the keyway so that the locking slider does not block operation of the sidebar.

5. The key as defined in claim 4, wherein the at least two portions contact two different surface portions on the slider.

6. The key as defined in claim 4, wherein the slider contact area surface configuration and its surface portions are horizontally spaced from the longitudinal axis of the key.

7. A master keying system for use with a twisting tumbler sidebar lock having a locking slider, and keys as defined in claim 4, surface portions on the slider and a slider contact area on the keys being configured so that one key will control operation and another key will not control operation of the slider when inserted in the same keyway.

8. A master keying system for us with a twisting tumbler sidebar lock having a locking slider, a key comprising a key blade having skew cut bittings extending vertically alone a longitudinally-extending top edge, and a slider contact area being divided horizontally into two portions and positioned at different predetermined locations and the locking slider having contact surfaces positioned at different predetermined locations so that a plurality of master keying variations are produced.

* * * * *

UNITED STATES PATENT AND TRADEMARK OFFICE

CERTIFICATE OF CORRECTION

PATENT NO. : 6,945,082 B2
DATED : September 20, 2005
INVENTOR(S) : Peter H. Field et al.

It is certified that error appears in the above-identified patent and that said Letters Patent is hereby corrected as shown below:

Column 1,
Line 43, "BIAXTAL" should be -- BIAXIAL --.

Column 8,
Line 19, "alone" should be -- along --.

Signed and Sealed this

Sixth Day of December, 2005

JON W. DUDAS
*Director of the United States Patent and Trademark Office*